US009791143B2

(12) United States Patent
Kim et al.

(10) Patent No.: US 9,791,143 B2
(45) Date of Patent: Oct. 17, 2017

(54) DOUBLY-SEALED WATERPROOF FLOODLIGHT AND METHOD FOR SAME

(71) Applicant: E-GM TECH, Gum-si, Gyeongsangbuk-do (KR)

(72) Inventors: Seoung Hun Kim, Daegu (KR); Young Min Jeon, Daegu (KR)

(73) Assignee: E—GM TECH, Gumi-si, Gyeongsangbuk-Do (KR)

( * ) Notice: Subject to any disclaimer, the term of this patent is extended or adjusted under 35 U.S.C. 154(b) by 16 days.

(21) Appl. No.: 14/770,972

(22) PCT Filed: Apr. 4, 2014

(86) PCT No.: PCT/KR2014/002905
§ 371 (c)(1),
(2) Date: Aug. 27, 2015

(87) PCT Pub. No.: WO2014/168379
PCT Pub. Date: Oct. 16, 2014

(65) Prior Publication Data

US 2016/0018098 A1 Jan. 21, 2016

(30) Foreign Application Priority Data

Apr. 9, 2013 (KR) ..... 10-2013-0038856

(51) Int. Cl.
*F21V 31/00* (2006.01)
*F21V 29/00* (2015.01)
(Continued)

(52) U.S. Cl.
CPC ..... *F21V 31/005* (2013.01); *F21K 9/90* (2013.01); *F21V 29/2212* (2013.01);
(Continued)

(58) Field of Classification Search
CPC ..... F21V 31/005; F21V 29/763; F21V 31/00
(Continued)

(56) References Cited

U.S. PATENT DOCUMENTS 7,445,352 B2 * 11/2008 Lin ..... F21S 8/00 362/101
9,039,238 B2 * 5/2015 Kim ..... F21K 9/00 362/218

(Continued)

*Primary Examiner* — Peggy Neils
*Assistant Examiner* — William N Harris
(74) *Attorney, Agent, or Firm* — LRK Patent Law Firm

(57) ABSTRACT

A doubly-sealed waterproof floodlight includes a heat dissipating portion, a lighting portion coupled to the bottom end of the heat dissipating portion, and a cover filled and coated with a sealing material, doubly-sealed, and integrally coupled to the heat dissipating portion. The heat dissipating portion includes a sealing portion formed on a side end of the heat dissipation portion, coated with the sealing material, and coupled to the cover. The cover includes a coupling portion formed on the top end of a side surface thereof. The coupling portion includes a sealing groove into which sealing material is filled for adhering and coupling the heat dissipating portion, a protruding support potion extending from the sealing groove, and a bottom surface portion which is flatly formed at a position lower than the protruding support portion, and in which the sealing material coated on the sealing portion is filled.

12 Claims, 7 Drawing Sheets

(51) Int. Cl.

| | |
|---|---|
| ***F21V 29/76*** | (2015.01) |
| ***F21K 9/90*** | (2016.01) |
| ***F21Y 115/10*** | (2016.01) |
| ***F21Y 105/16*** | (2016.01) |

(52) U.S. Cl.
CPC ..... *F21V 29/763* (2015.01); *F21Y 2105/16* (2016.08); *F21Y 2115/10* (2016.08)

(58) Field of Classification Search
USPC ..... 362/267, 645, 158
See application file for complete search history.

(56) References Cited

U.S. PATENT DOCUMENTS

2006/0227558 A1* 10/2006 Osawa ..... F21V 3/00 362/351
2010/0296287 A1* 11/2010 Huang ..... F21V 15/013 362/249.02
2011/0280020 A1* 11/2011 Chen ..... F21V 5/007 362/294
2012/0188766 A1* 7/2012 Lu ..... F21V 29/004 362/249.02

* cited by examiner

DOUBLY-SEALED WATERPROOF FLOODLIGHT AND METHOD FOR SAME

FIELD OF THE INVENTION

The present disclosure relates to a doubly-sealed LED floodlight configured to enhance a waterproof characteristic of the LED floodlight by doubly-sealing a heat dissipating portion attached by a cover and a lighting portion, and a sealing method thereof.

BACKGROUND ART

In general, although floodlights, landscape lighting lamps and advertisement lamps have been occupied by various light sources such as fluorescent lights, neon lights and halogen lamps, the recent trends are that LEDs (Light Emitting Diodes) have come into limelight as light sources in these fields. The reason of the LED being focused as a light source is because of device characteristics. Although conventional light sources have used mercury for illumination, the LED has advantages in that the LED is environment-friendly with reduced upkeep due to less power consumption and with a long life and excellent in durability and strong over the conventional light sources. Furthermore, usage of LEDs is accelerated due to advantages such as gradually increased luminance and light emitting efficiency and no fear of electric shock because of driving in a low voltage.

Even if waterproof floodlights using LEDs for illumination are manufactured, limitations are incurred in manufacturing the waterproof floodlights according to manufacturing method of heat dissipating portion attached with a lighting portion including the LED. The heat dissipating portion is generally manufactured by a die casting method and an extruding method. The die casting method is advantageous of no limit to shapes to allow forming a 3D heat dissipating portion, but disadvantageous of reduced heat dissipating efficiency over a heat dissipating method. Although the heat dissipating, method is higher than the die casting method in terms of heat dissipating efficiency, the heat dissipating method suffers from disadvantages in terms of formation of a shape due to the fact that it can form a heat dissipating portion only in 2D instead of 3D.

Furthermore, even if a heat dissipating portion is manufactured by any method of die casting method or extruding method, both methods suffer from drawbacks that require separate packing for preventing introduction of moisture into the heat dissipating portion. FIG. 1 illustrates a waterproof floodlight (100) manufactured by die casting method, where the waterproof floodlight (100) provides a packing (130) coupled between a cover (120) and a heat dissipating portion (110). There are cases where a sealing is additionally formed near the packing (130) in order to obtain a double waterproof effect. However, the method illustrated in FIG. 1 suffers from disadvantages in that a heat dissipating portion, a cover and a packing must be of very high quality and the defect generation probability is very high in the assembly process.

A technology of mounting a packing inside a cover has been developed in order to solve the aforementioned disadvantages/problems. Referring to FIG. 2, Korea Laid-Open Patent No. 2012-0013681A discloses a waterproof and heat dissipating LED module. The LED module (200) includes a heat dissipating portion (210) attached and coupled to a substrate (220) mounted with an LED, a substrate (200), and a protective cover (240) of the substrate, where an O-ring (230) for waterproof is mounted between the substrate (220) and the cover (240), whereby waterproof function by an outside cover (240) and a waterproof function by an inner O-ring are performed.

However, the Korea Laid-Open Patent suffers from disadvantages in that assembly is cumbersome and inconvenient because a separate configuration (O-ring 230) such as padding must be included even if double waterproof function is implemented. Furthermore, even if an inner padding is included, a problem still exists because a small but fine gap exists between the cover and the inner padding to introduce moisture into the waterproof and heat dissipating LED module. Thus, waterproof floodlights are required that need a simple assembly process and perfect sealing using a minimum configuration only.

DISCLOSURE

Technical Problem

The present disclosure is disclosed to provide a doubly-sealed LED floodlight configured to simplify an assembly process only using a heat dissipating portion and a cover, and a sealing method thereof.

It is another object of the present disclosure is, to provide a doubly-sealed LED floodlight enhanced in waterproof characteristics, and a sealing method thereof.

It is still another object of the present disclosure is to provide a doubly-sealed LED floodlight manufacturable free from manufacturing methods (a die casting method or an extruding method) of heat dissipating portion, and a sealing method thereof.

Technical Solution

In one general aspect of the present disclosure, there is provided a doubly-sealed LED floodlight, the doubly-sealed LED floodlight comprising:

a heat dissipating portion;

a lighting portion adhered and coupled to a bottom end of the heat dissipating portion; and a cover integrally coupled to the heat dissipating portion by being filled and coated with a sealing material and being doubly sealed, wherein the heat dissipating portion includes a sealing portion formed at a lateral end of the heat dissipating portion and adhered and coupled to the cover by being coated with the sealing material, the cover includes a coupling portion formed at a top end of a lateral surface to be coupled to the heat dissipating portion by filling-in and coating of the sealing material, and the coupling portion includes a sealing groove filled with the sealing material to attach and couple the heat dissipating portion, a protruding support portion extensively formed from the sealing groove and supporting a lateral surface to allow the heat dissipating portion to be fixed, and a bottom surface portion flatly formed at a position lower than the protruding support portion to be attached and coupled to the heat dissipating portion by being filed with the sealing material coated on the sealing portion.

Preferably, but not necessarily, the heat dissipating portion may be formed in a plane shape and the cover is formed in a U shape.

Preferably, but not necessarily, the heat dissipating portion may be formed by an extruding method or a die casting method.

Preferably, but not necessarily, the cover may be formed with a material of transparent property.

Preferably, but not necessarily, the sealing material may be formed with a silicon material.

Preferably, but not necessarily, the heat dissipating portion may be formed with a material of high thermal conductivity.

In another general aspect of the present disclosure, there is provided a sealing method of doubly-sealed LED floodlight, the method comprising:

attaching and coupling a lighting portion to a heat dissipating portion;

filling a sealing material into a coupling portion of a cover (first sealing step);

attaching and coupling the heat dissipating portion to a coupling portion of the cover; and sealing the heat dissipating portion and the cover by coating the sealing material on the heat dissipating portion, and connectively filling the sealing material up to the coupling portion (second sealing step), wherein the coupling portion includes a sealing groove filled with the sealing material to attach and couple the heat dissipating portion, a protruding support portion extensively formed from the sealing groove and supporting a lateral surface to allow the heat dissipating portion to be fixed, and a bottom surface portion flatly formed at a position lower than the protruding support portion to be attached and coupled to the heat dissipating portion by being filed with the sealing material coated on the sealing portion.

Preferably, but not necessarily, the heat dissipating portion may be formed in a plane shape and the cover is formed in, a U shape.

Preferably, but not necessarily, the heat dissipating portion may be formed by an extruding method or a die casting method.

Preferably, but not necessarily, the cover may be formed with a material of transparent property.

Preferably, but not necessarily, the sealing material may be formed with a silicon material.

Preferably, but not necessarily, the heat dissipating portion may be formed with a material of high thermal conductivity.

Advantageous Effects

As discussed above, the doubly-sealed LED floodlight and sealing method thereof according to present disclosure has an advantageous effect in that an assembly process can be simplified because of being freed from a separate configuration for waterproofness.

Another advantageous effect is that waterproof effect can be enhanced by preventing introduction of moisture by double-sealing.

Still another advantageous effect is that a manufacturing cost of waterproof floodlight can be reduced by using a minimum configuration and the waterproof floodlight can be manufactured free regardless of manufacturing method (die casting method or extruding method) of heat dissipating portion

BEST MODE

Advantages and characteristics of the present embodiment and methods for addressing the same will be clearly understood from the following embodiments taken in conjunction with the annexed drawings. However, the present disclosure is not limited to the embodiments and may be realized in various other forms. The embodiments are only provided to more completely illustrate the present disclosure and to render a person having ordinary skill in the art to fully understand the scope of the present disclosure. The scope of the present disclosure is defined only by the claims. Accordingly, in some embodiments, well-known processes, well-known device structures and well-known techniques are not illustrated in detail to avoid unclear interpretation of the present disclosure. The same reference numbers will be used throughout the specification to refer to the same or like parts.

Figure 1:
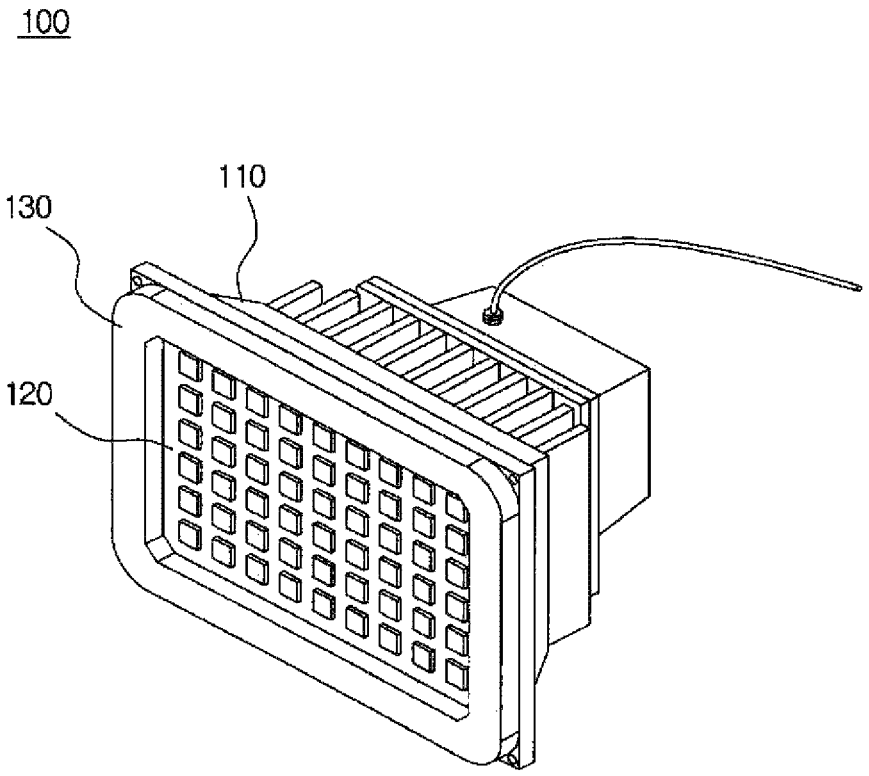
FIG. 1 RELATED ART
FIG. 1 is a schematic view illustrating a waterproof floodlight manufactured by die casting method according to prior art.
Figure 2:
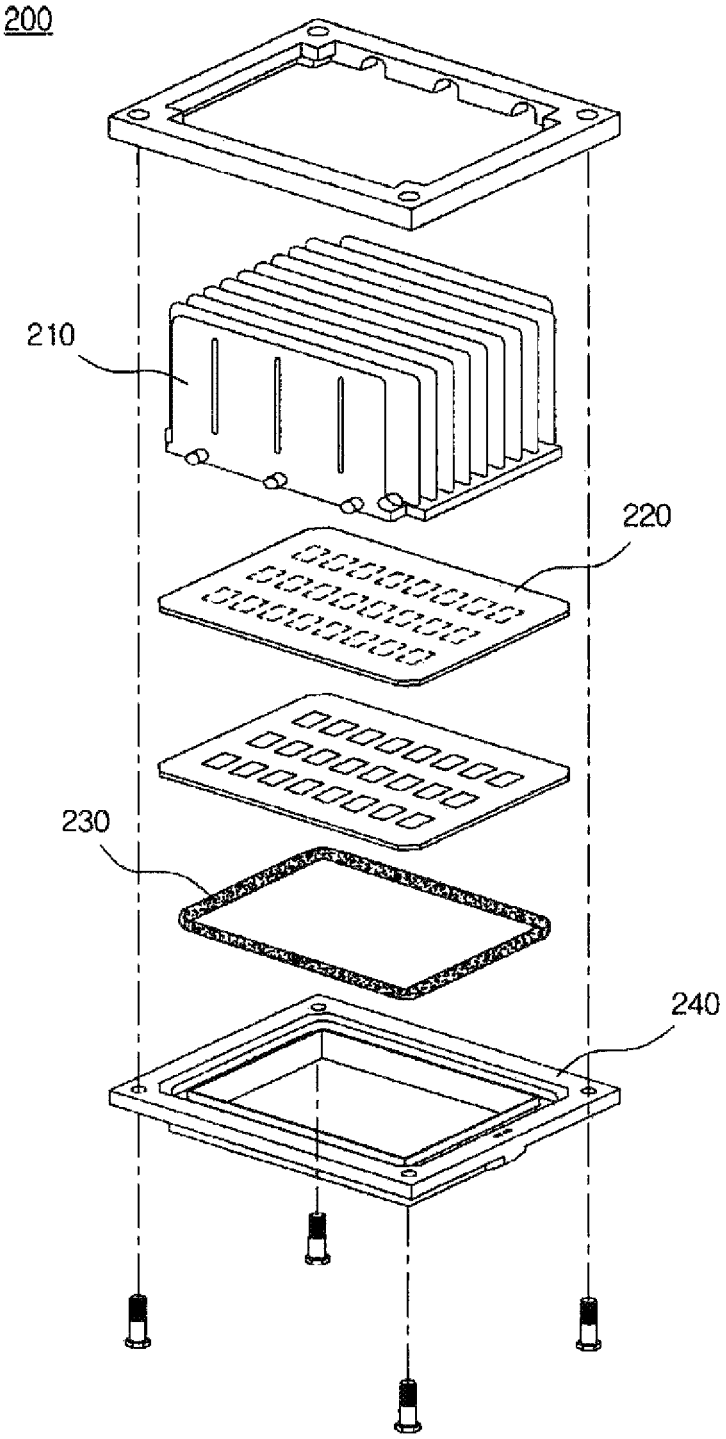
FIG. 2 RELATED ART
FIG. 2 is a schematic view illustrating a waterproof and heat dissipating LED module according to prior art.
Figure 3:
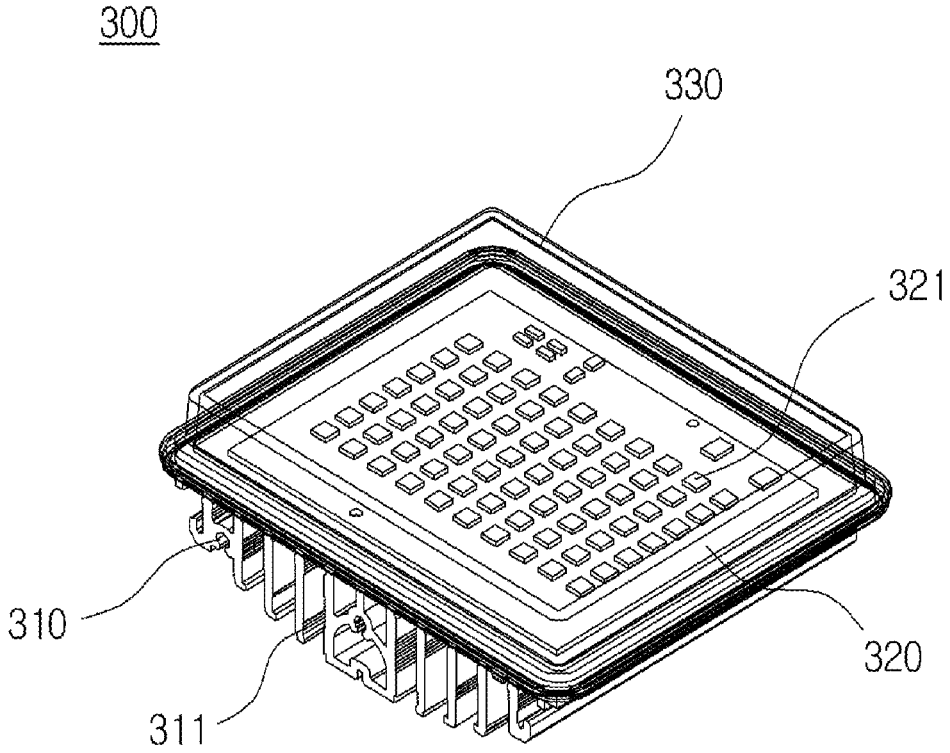
FIG. 3 is a perspective view illustrating a doubly-sealed LED floodlight according to an exemplary embodiment of the present disclosure.

FIG. 3 is a perspective view illustrating a doubly-sealed LED floodlight according to an exemplary embodiment of the present disclosure.

An entire coupled shape of the present disclosure may be known from FIG. 3. A doubly-sealed LED floodlight (waterproof floodlight, 300) according to an exemplary embodiment of the present disclosure may include a heat dissipating portion (310), a lighting portion (320) and a cover (330).

The heat dissipating portion (310) may include a flat plate (410) coupled to the lighting portion (320), and may be formed by extending a plate-shaped heat dissipating plate (311) in order to maximize a heat emitting area of the flat plate (410). Although the heat dissipating portion (310) according to the present disclosure is formed by extruding method to include a plain-shaped flat plate (410), the heat dissipating portion (310) may take a 3D (three dimensional) shape manufactured by a die casting method in addition to the extruding method. When the heat dissipating portion (310) takes a shape of plain-shaped flat plate by the extruding method, the cover (330) may preferably take a U-shaped 3D form, and when the heat dissipating portion (310) takes a shape of plain-shaped flat plate by the die casting method, the cover (330) may preferably take, a plain surface shape in terms, of assembly process.

The heat dissipating portion (310) may be formed with a material of high thermal conductivity in order to maximize a heat emitting area. For example, the material of high thermal conductivity may be a metal, and aluminum or steel among the metals may be representatively used.

The heat dissipating portion (310) may be coupled with the lighting portion (320) at a bottom portion, and coupled with the cover (33), where a lateral portion coupled to the cover is doubly-sealed. The double-sealing method will be described later.

The lighting portion (320) is a configuration for emitting a light and an LED is a representative. The present disclosure is not limited thereto, and all lighting configurations capable of emitting light may be included for the light portion (320). The lighting portion (320) may be a single piece of light generation portion (321), but may take a module comprised of a plurality of light generation portions (321). The light portion (320) generates a light by receiving a power through an internal circuit, and emits light to outside through the cover (330).

The lighting portion (320) may be attached and coupled to a bottom portion of the heat dissipating portion (310), and be positioned opposite to the cover (330) above the lighting portion (330).

The cover (330) may be coupled to the heat dissipating portion (310) by being doubly-sealed, and may be coupled to a lateral portion thereof to the lateral portion of the heat dissipating portion (310). The cover (330) may be coupled to the heat dissipating portion (310) by filling a sealing material at a lateral portion where the heat dissipating portion (310) is positioned. Then, the doubly-sealing is implemented by filling a gap between the heat dissipating portion (310) and the cover (330) after re-applying the sealing material on a distal portion of the heating dissipating portion (310).

The cover (330) may be differently formed according to the shape of the heat dissipating portion (310). When the heat dissipating portion (310) takes a plane shape by way of extruding method, the cover (330) may preferably take a U-shaped 3D form, and when the heat dissipating portion (310) takes a U-shaped form by way of die casting method, the cover (330) may preferably take a plane shape in terms of assembly process.

The cover (330) may be formed with a material of transparent property, the material of which may be representatively glass or polycarbonate.

A material strong in viscosity may, be used for the sealing material, and silicon may be used that is commonly employed for the purpose of the present disclosure in terms of reasonable manufacturing cost and simplicity of assembly.

Figure 4:
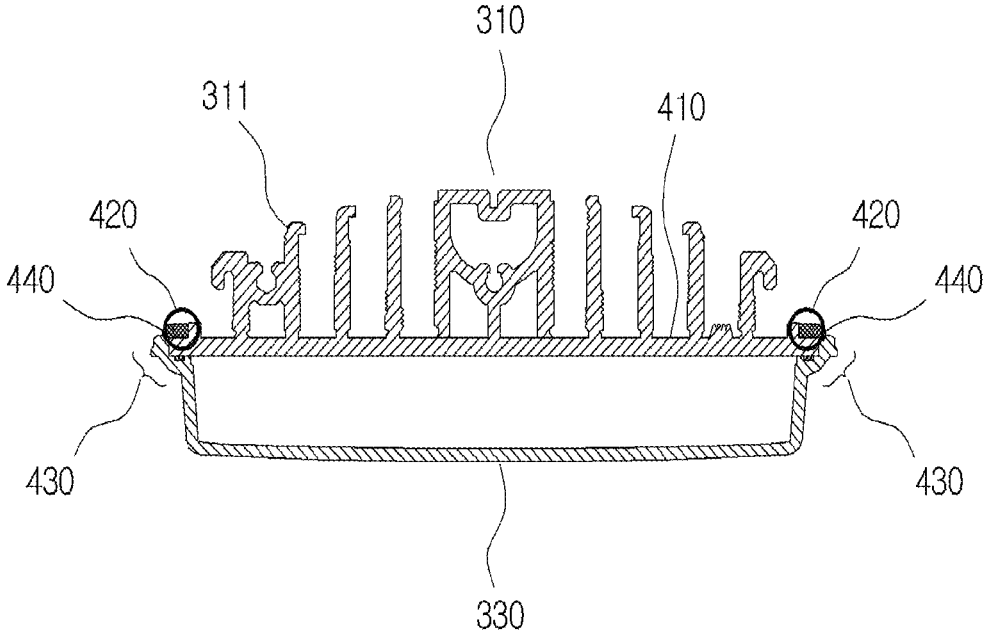
FIG. 4 is a cross-sectional view illustrating a doubly-sealed LED floodlight according to an exemplary embodiment of the present disclosure.

FIG. 4 is a cross-sectional view illustrating a doubly-sealed LED floodlight according to an exemplary embodiment of the present disclosure.

Referring to FIG. 4, the doubly-sealed configuration can be noticed through the cross-section of the coupled waterproof floodlight according to the present disclosure. The heat dissipating portion (310) of the present disclosure may include a sealing portion (420) and the cover (330) may include a coupling portion (430).

The heat dissipating portion (310) may include a sealing portion (420) formed at a lateral portion of the heat dissipating portion (310) and attached and coupled to the cover (330) by being applied with a sealing material. The sealing portion (420) is a configuration formed at a distal portion of edge at the heat dissipating portion (310) and applied with a sealing material when coupled to the cover (330).

Figure 5:
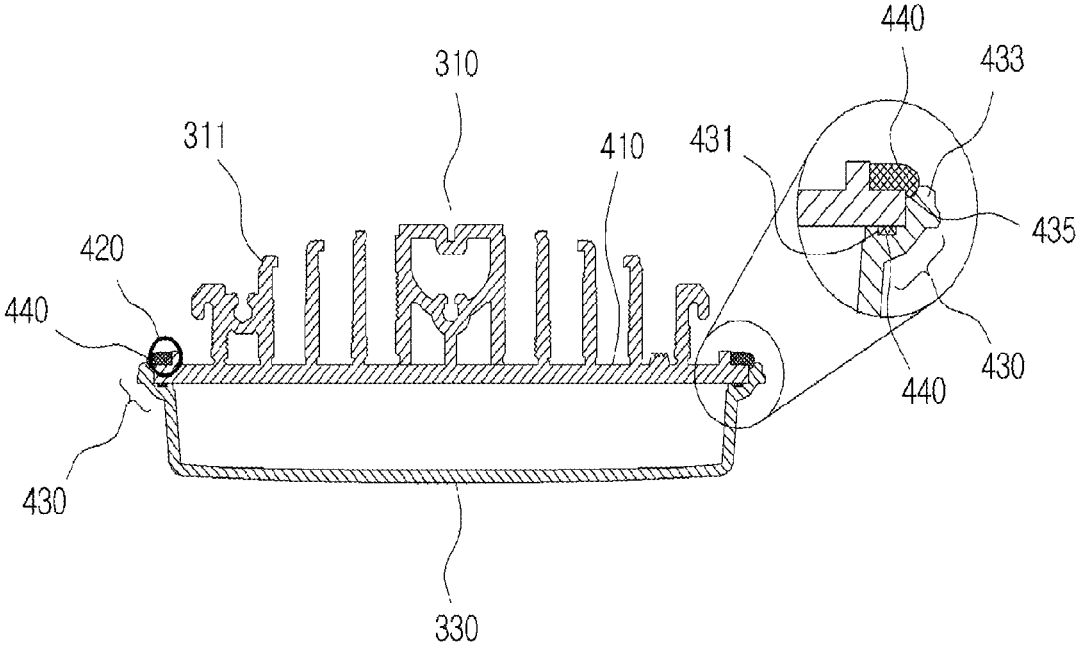
FIG. 5 is an enlarged view illustrating a cross-section of a doubly-sealed LED floodlight according to an exemplary embodiment of the present disclosure.

The cover (330) is configured in a manner such that when the flat plate (410) of the heat dissipating portion (310) is initially attached and coupled to the cover (330) through the sealing material filled in the coupling portion (430), the sealing material applied on the sealing portion (420) is secondly attached and coupled to the cover (330) by sealing the heat dissipating portion (310) and the cover (330), whereby assembly of the doubly-sealed waterproof floodlight (300) is finished, the detailed description of which will be described with reference to FIG. 5.

The cover (330) may include a coupling portion (430) formed at a top portion of a lateral surface and coupled to the heat dissipating portion by filling and applying of the sealing material. The coupling portion (430) is a configuration formed at a distal portion of edge at the cover (330) and defines a place coupled to the flat plate (410) of the heat dissipating portion (310) where the sealing material is filled at a groove. When the flat plate (410) of the heat dissipating portion (310) is initially attached and coupled to the cover (330) through the sealing material filled in the coupling portion (430) of the cover (330), the sealing material applied on the sealing portion (420) is secondly attached and coupled to the cover (330) by sealing the cover (330) and the heat dissipating portion (310), whereby assembly of the doubly-sealed waterproof floodlight (300) is completed, the detailed description of which will be described with reference to FIG. 5.

FIG. 5 is an enlarged view illustrating a cross-section of a doubly-sealed LED floodlight according to an exemplary embodiment of the present disclosure.

Referring to FIG. 5, the doubly-sealed configuration can be noticed through the cross-section of the coupled waterproof floodlight according to the present disclosure. The heat dissipating portion (310) of the present disclosure may include a sealing portion (420), and the cover (330) may include a coupling portion (430).

The sealing portion (420) is a place formed at a lateral portion of the heat dissipating portion (310) applied with a sealing material (440). The sealing material (440) is applied on the coupling portion (430) and the applied sealing material (440) flows up to a bottom surface portion (435) of the coupling portion (430) at the cover (330). The flowed sealing material (440) fills the bottom surface portion (435) from a bottom thereof, and seals the flat plate (410) of the heat dissipating portion (310) and the coupling portion (430) of the cover by attaching and coupling the flat plate (410) of the heat dissipating portion (310) to the coupling portion (430) of the cover. The sealing material (440) of the sealing portion (420) performs a second sealing following the first sealing by the sealing material (440) filled in a sealing groove (431) of the coupling portion (430).

The coupling portion (430) is a place that performs the first sealing by being formed at a top portion of a lateral surface of the cover (330). The coupling portion (430) may include a sealing groove (431), a protruding support portion (433) and a bottom surface portion (435). The protruding support portion (433) may be integrally formed with the sealing groove (431) by being extended from the sealing groove (431) to support the flat plate (410) so that the heat dissipating portion (310) can be fixed. The protruding support portion (433) is adhered and coupled to the heat dissipating portion (310) through first (initial) and second sealing. The bottom surface portion (435) may be integrally formed with the protruding support portion (433) and the sealing groove (431) by being extended from the protruding support portion (433) and the sealing groove (431) and may take a flat shape by being positioned at a place lower than the protruding support portion (433). The bottom surface portion (435) is a place where the sealing material (440) applied on the sealing portion (420) is filled by flowing-down, and a place the second sealing, is implemented where the sealing material (440) is filled from a bottom of the bottom surface portion (435). The heat dissipating portion (310) is coupled to the cover (330) through the second sealing.

Figure 6:
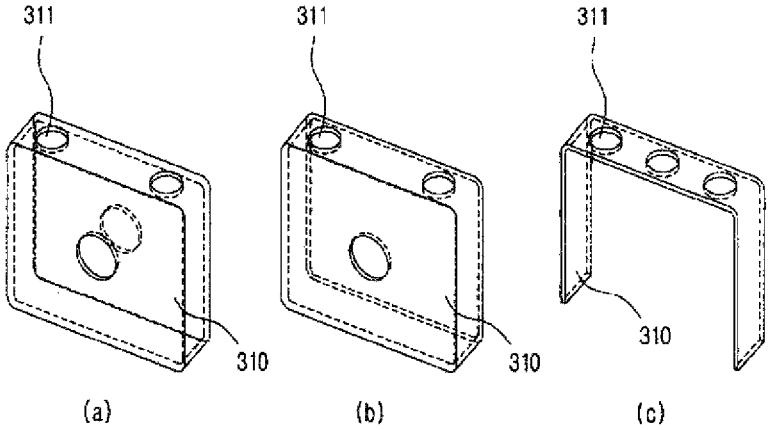
FIG. 6 is a coupled configurational view illustrating a doubly-sealed LED floodlight according to an exemplary embodiment of the present disclosure.

FIG. 6 is a coupled configurational view illustrating a doubly-sealed LED floodlight according to an exemplary embodiment of the present disclosure.

Referring to FIG. 6, the coupling of the waterproof floodlight (300) may be implemented in the order of attachment and coupling of the heat dissipating portion (310) to the lighting portion (320), and coupling of the heat dissipating portion (310) attached by the lighting portion (320) to the cover (330). Thus, a separate configuration for waterproofness necessary for the conventional waterproof floodlight can be dispensed with, whereby the waterproof floodlight (300) according to the present disclosure can be simply manufactured using the heat dissipating portion (310), the lighting portion (320) and the cover (330).

The heat dissipating portion (310) may include a sealing portion (420), and the cover (330) may include a coupling portion (430).

Figure 7:
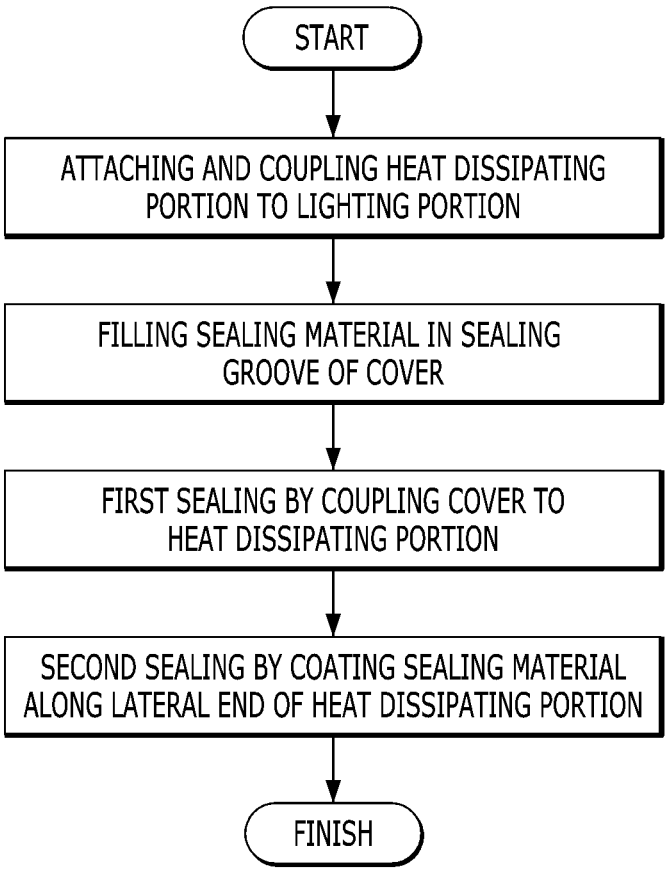
FIG. 7 is a coupled flowchart illustrating a doubly-sealed LED floodlight according to an exemplary embodiment of the present disclosure.

FIG. 7 is a coupled flowchart illustrating a doubly-sealed LED floodlight according to an exemplary embodiment of the present disclosure.

Referring to FIG. 7, the double-sealing of the waterproof floodlight coupled according to the present disclosure may be operated in the following order.

The heating dissipating portion (310) and the lighting portion (320) are attached and coupled (S701). This order of attaching and coupling of the heating dissipating portion (310) to the lighting portion (320) is necessitated because the lighting portion (320) is positioned inside the waterproof floodlight (300) and covered by the cover (330).

The sealing material (440) is fully filled in the sealing groove (431) formed at a lateral portion of the cover (330) (S703), which is a preparatory step for first sealing, where the flat plate (410) of the heat dissipating portion (310) is attached and coupled by the sealing material (440). The cover (330) is flipped over and the heat dissipating portion (310) attached by the lighting portion (320) is coupled to allow a lateral portion to be matched (S705), whereby the first sealing step is completed.

The sealing material (440) is applied along the sealing portion (420) positioned at a lateral portion of the heating dissipating portion (310) coupled with the cover (330) to allow the sealing material (440) to flow up to the bottom surface portion (435) of the cover (330), whereby the bottom surface portion (435) can be filled (S707). When the sealing material (440) is filled up to a height of the protruding support portion (433), the heat dissipating portion (310) and the cover (330) are attached and coupled by the sealing material (440), whereby the second sealing is completed.

Meantime, although the present disclosure has been described in detail with reference to the foregoing embodiments and advantages, many alternatives, modifications, and variations will be apparent to those skilled in the art within the metes and bounds of the claims. Therefore, it should be understood that the above-described embodiments are not limited by any of the details of the foregoing description, unless otherwise specified, but rather should be construed broadly within the scope as defined in the appended claims

INDUSTRIAL APPLICABILITY

The present disclosure may be applicable to a doubly-sealed LED floodlight, whereby an assembly process can be simplified because of being freed from a separate configuration for waterproofness, waterproof effect can be enhanced by preventing introduction of moisture by double-sealing, and a manufacturing cost of waterproof floodlight can be reduced by using a minimum configuration and the waterproof floodlight can be manufactured free regardless of manufacturing method (die casting method or extruding method) of heat dissipating portion.

The above-mentioned floodlight according to the present disclosure may, however, be embodied in many different forms and should not be construed as limited to the embodiment set forth herein. Thus, it is intended that embodiment of the present disclosure may cover the modifications and variations of this disclosure provided they come within the scope of the appended claims and their equivalents. While particular features or aspects may have been disclosed with respect to several embodiments, such features or aspects may be selectively combined with one or more other features and/or aspects of other embodiments as may be desired.

The invention claimed is:

1. A doubly-sealed LED floodlight comprising:

a heat dissipating portion;

a lighting portion adhered and coupled to a bottom portion of the heat dissipating portion; and a cover coupled to the heat dissipating portion by being filled and applied with a sealing material and being doubly sealed, wherein the heat dissipating portion includes a sealing portion formed at a lateral portion of the heat dissipating portion and adhered and coupled to the cover by being applied with the sealing material, wherein the cover includes a coupling portion formed at a top of a lateral portion of the cover to be coupled to the heat dissipating portion by filling-in and applying of the sealing material, and wherein the coupling portion includes:

a portion formed with a sealing groove and attached and coupled to a bottom portion of the sealing portion by filling the sealing material in the sealing groove, a protruding support portion extended from the portion formed with the sealing groove and supporting, and surrounding the lateral portion of the heat dissipating portion to allow the heat dissipating portion to be fixed, and a bottom surface portion flatly formed at a position lower than a top of the protruding support portion to be attached and coupled to a side portion of the sealing portion by being filled with the sealing material applied on the sealing portion.

2. The floodlight of claim 1, wherein the heat dissipating portion takes a plane shape and the cover takes a U shape.

3. The floodlight of claim 1, wherein the heat dissipating, portion is formed by an extrusion or a die-cast.

4. The floodlight of claim 1, wherein the cover is formed with a transparent material.

5. The floodlight of claim 1, wherein the sealing material includes a silicon material.

6. The floodlight of claim 1, wherein the heat dissipating portion is formed with a material of thermal conductivity.

7. A sealing method of a doubly-sealed LED floodlight, the method comprising:

attaching and coupling a lighting portion to a heat dissipating portion;

filling a sealing material in a sealing groove formed in an upper portion of a lateral portion of a cover;

attaching a sealing portion on the portion formed with the sealing groove, wherein the cover has a protruding support portion extending outwardly and upwardly from the portion formed with the sealing groove outside of the sealing portion; and filling, and applying the sealing material on an upper surface of the sealing portion and on a bottom surface portion flatly formed at a position lower than a top of the protruding support portion, wherein the sealing portion is a lateral portion of the heat dissipating portion.

8. The method of claim 7, wherein the heat dissipating portion takes a plane shape and the cover takes a U shape.

9. The method of claim 7, wherein the heat dissipating portion is formed by an extrusion or a die-cast.

10. The method of claim 7, wherein the cover is formed with a transparent material.

11. The method of claim 7, wherein the sealing material includes a silicon material.

12. The method of claim 7, wherein the heat dissipating portion is formed with a material of thermal conductivity.

* * * * *